US010329790B2

(12) United States Patent
Choi

(10) Patent No.: US 10,329,790 B2
(45) Date of Patent: Jun. 25, 2019

(54) TENT FRAME AND TENT WITH EXTENDED TOP

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 15/955,457

(22) Filed: Apr. 17, 2018

(65) Prior Publication Data

US 2018/0305951 A1 Oct. 25, 2018

(30) Foreign Application Priority Data

Apr. 21, 2017 (CN) ..... 2017 2 0424348 U

(51) Int. Cl.

| | |
|---|---|
| ***E04H 15/40*** | (2006.01) |
| ***E04H 15/32*** | (2006.01) |
| ***E04H 15/60*** | (2006.01) |
| ***E04H 15/48*** | (2006.01) |
| ***E04H 15/42*** | (2006.01) |

(52) U.S. Cl.

CPC ..... *E04H 15/405* (2013.01); *E04H 15/42* (2013.01); *E04H 15/425* (2013.01); *E04H 15/48* (2013.01)

(58) Field of Classification Search

CPC ..... E04H 15/405; E04H 15/48; E04H 15/32; E04H 15/60

See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 910,117 | A | 1/1909 | Crocker |
| 952,879 | A | 3/1910 | Crocker |

(Continued)

FOREIGN PATENT DOCUMENTS

| | | | |
|---|---|---|---|
| CA | 2022369 | A1 | 2/1991 |
| CN | 1076987 | A | 10/1993 |

(Continued)

OTHER PUBLICATIONS

U.S. Appl. No. 14/311,564, filed Jun. 23, 2014.

(Continued)

*Primary Examiner* — Noah Chandler Hawk

(74) *Attorney, Agent, or Firm* — Morgan, Lewis & Bockius LLP

(57) ABSTRACT

Disclosed are tents/tent frames with extended tops, and connectors facilitating construction of tents/tent frames with extended tops. A connector includes first and second side walls spaced apart in a first direction to form a groove along a second direction for receiving an upper pole. It also includes first upper and lower lugs spaced apart in a third direction to form a first slot for receiving a first side pole, and second upper and lower lugs spaced apart in the third direction to form a second slot for receiving a second side pole. The upper pole is rotatable in a plane limited by the first and second side walls. The first or second side pole is rotatable in a plane limited by the first or second upper and lower lugs.

14 Claims, 9 Drawing Sheets

(56) References Cited

U.S. PATENT DOCUMENTS 1,061,547 A 5/1913 Kennedy
1,129,194 A 2/1915 Henley
1,347,107 A 7/1920 McCann
1,601,664 A 9/1926 Ackerman
1,687,722 A 10/1928 Goldberg
2,113,118 A 4/1938 Pyati
2,137,625 A 11/1938 Norvell
2,227,554 A 1/1941 Riordon
2,306,706 A 12/1942 Lucas
2,448,895 A 9/1948 Lawrence
2,530,765 A 11/1950 Greenup
2,555,220 A 5/1951 Brown
2,716,993 A 9/1955 Codrick
2,731,972 A 1/1956 Braun
2,948,287 A 8/1960 Rupert
2,962,034 A 11/1960 Finlayson
2,984,249 A 5/1961 Sears, Jr. et al.
3,054,413 A 9/1962 Eshelman
3,333,373 A 8/1967 Taylor et al.
3,454,021 A 7/1969 Morris
3,738,378 A 6/1973 Williams
3,766,932 A 10/1973 Sidis
3,810,482 A 5/1974 Beavers
3,929,146 A 12/1975 Maiken
4,003,181 A 1/1977 Robinson
4,037,978 A 7/1977 Connelly
4,066,089 A * 1/1978 Rainwater ..... E04H 15/48 135/114
4,077,417 A 3/1978 Beavers
4,148,332 A 4/1979 Huddle
4,201,237 A 5/1980 Watts et al.
4,280,521 A 7/1981 Zeigler
4,285,354 A 8/1981 Beavers
4,285,355 A 8/1981 Lundblade
4,627,210 A 12/1986 Beaulieu
4,637,748 A 1/1987 Beavers
4,750,509 A 6/1988 Kim
4,787,182 A 11/1988 Serge
4,819,680 A 4/1989 Beavers
4,827,958 A 5/1989 Cantwell
4,838,003 A 6/1989 Zeigler
4,941,499 A 7/1990 Pelsue et al.
4,944,321 A 7/1990 Moyet-Ortiz
4,971,090 A 11/1990 Uhl
4,998,552 A 3/1991 Niksic
5,230,358 A 7/1993 Forell
5,240,020 A 8/1993 Byers
5,255,698 A 10/1993 Riley
5,263,507 A 11/1993 Chuang
5,293,890 A 3/1994 Park et al.
5,328,286 A 7/1994 Lee
5,333,634 A 8/1994 Taylor
5,361,794 A 11/1994 Brady
5,421,355 A 6/1995 Cantwell
5,423,341 A 6/1995 Brady
5,617,681 A 4/1997 Lyons
5,628,338 A 5/1997 Stumbo
5,634,483 A 6/1997 Gwin
5,666,986 A 9/1997 Fox
5,701,923 A 12/1997 Losi, Jr. et al.
5,732,726 A 3/1998 Lee
5,771,651 A 6/1998 Shiina
5,771,654 A 6/1998 Moore et al.
5,797,695 A 8/1998 Prusmack
5,884,646 A 3/1999 Ju
5,943,837 A 8/1999 Esser et al.
6,021,795 A 2/2000 Long et al.
6,032,430 A 3/2000 Soukup
6,167,898 B1 1/2001 Larga et al.
6,230,728 B1 5/2001 Reese
6,283,136 B1 9/2001 Chen
6,286,530 B1 9/2001 Hussey
6,296,415 B1 10/2001 Johnson et al.
6,463,948 B2 10/2002 Lee
6,516,823 B1 2/2003 Glover et al.
6,591,571 B2 7/2003 Fritsche et al.
6,604,844 B2 8/2003 Hussey
6,666,223 B2 12/2003 Price et al.
6,772,780 B2 8/2004 Price
6,776,179 B1 8/2004 Chen
6,854,476 B1 2/2005 Chai
6,868,858 B2 3/2005 Suh
6,874,519 B2 4/2005 Chiang
6,892,744 B2 5/2005 Feldpausch et al.
7,025,075 B2 4/2006 Suh
7,040,585 B2 5/2006 Cheng et al.
7,059,094 B2 6/2006 Yamawaki
D544,941 S 6/2007 Rogers
7,299,813 B2 11/2007 Ochi
7,311,113 B2 12/2007 Suh
7,316,239 B2 1/2008 Yang
7,392,610 B2 7/2008 Jedlicka
RE40,544 E 10/2008 Suh
7,481,235 B2 1/2009 Prusmack
7,546,845 B2 6/2009 Prusmack
7,607,447 B1 10/2009 Han
7,628,165 B2 12/2009 Rothwell
7,656,024 B2 2/2010 Elbanhawy
7,686,024 B1 3/2010 Lai
7,810,514 B2 10/2010 Lah
7,861,736 B2 1/2011 Choi
7,891,367 B2 2/2011 Ma
8,033,289 B2 10/2011 Buckley
8,047,218 B1 11/2011 Shin
8,056,573 B2 11/2011 Panigot
8,069,872 B2 12/2011 Bae
8,156,952 B2 4/2012 Chesness
8,186,369 B2 5/2012 Reeb
8,469,045 B2 6/2013 Zhou
8,485,208 B2 7/2013 Seo
8,590,554 B2 11/2013 Choi
D705,884 S 5/2014 Jin
8,763,621 B2 7/2014 Jin
8,869,814 B2 10/2014 Jin
8,910,648 B2 12/2014 Jin
8,919,364 B1 12/2014 Russell
9,051,034 B1 6/2015 Li
9,140,030 B2 9/2015 Jin
9,192,215 B2 11/2015 Ma
9,243,423 B2 1/2016 Jin
9,243,424 B2 1/2016 Jin
9,382,723 B2 7/2016 Choi
2001/0050098 A1 12/2001 Lee
2003/0005953 A1 1/2003 Erbetta et al.
2006/0016467 A1 1/2006 Bae
2006/0289048 A1 12/2006 Choi
2007/0051399 A1 3/2007 Jung
2007/0215192 A1 9/2007 Hoffman
2008/0223425 A1 9/2008 Shumate
2009/0173369 A1 7/2009 Lah
2012/0055525 A1 3/2012 Choi
2012/0318316 A1 12/2012 Choi et al.
2013/0014794 A1 1/2013 Jin
2013/0247948 A1 9/2013 Lovely et al.
2013/0318316 A1 11/2013 Yamada
2014/0076371 A1 3/2014 Jin
2014/0076372 A1 3/2014 Jin
2014/0109945 A1 4/2014 Jin
2014/0246062 A1 9/2014 Ma
2014/0261601 A1 9/2014 Jin
2014/0290710 A1 10/2014 Choi
2014/0311540 A1 10/2014 Choi
2015/0068573 A1 3/2015 Jin
2015/0083177 A1 3/2015 Hotes
2015/0167343 A1 6/2015 Fang
2015/0167344 A1 6/2015 Li
2015/0275541 A1 10/2015 Lamke
2015/0284974 A1 10/2015 Choi
2016/0060897 A1 3/2016 Baoqing
2016/0242567 A1 8/2016 Lime
2016/0281385 A1 9/2016 Choi
2016/0290003 A1 10/2016 Yang

(56) References Cited

U.S. PATENT DOCUMENTS

FOREIGN PATENT DOCUMENTS

| | | | | | |
|---|---|---|---|---|---|
| CN | 1030790 | C | | 1/1996 | |
| CN | 2401649 | Y | | 10/2000 | |
| CN | 2506736 | Y | | 8/2002 | |
| CN | 2635827 | Y | | 8/2004 | |
| CN | 2697225 | Y | | 5/2005 | |
| CN | 201013097 | Y | | 1/2008 | |
| CN | 201103269 | Y | | 8/2008 | |
| CN | 201129060 | Y | | 10/2008 | |
| CN | 201202302 | Y | | 3/2009 | |
| CN | 201695751 | U | | 1/2011 | |
| CN | 102691439 | A | | 9/2012 | |
| CN | 201220478761.4 | | | 9/2012 | |
| CN | 202767622 | U | | 3/2013 | |
| CN | 203034904 | U | | 7/2013 | |
| CN | 103590650 | B | | 2/2014 | |
| CN | 204163467 | U | | 2/2015 | |
| FR | 1 121 851 | | | 8/1956 | |
| FR | 68588 | | | 5/1958 | |
| GB | 2201703 | A | | 9/1988 | |
| GB | 2259927 | A | | 3/1993 | |
| GB | 2535221 | A | * | 8/2016 | ..... E04H 15/32 |
| KR | 10-2011-0054253 | A | | 5/2011 | |
| WO | WO 2011/022764 | A1 | | 3/2011 | |
| WO | WO 2013/116545 | A1 | | 8/2013 | |
| WO | WO 2014/181953 | A1 | | 11/2014 | |

OTHER PUBLICATIONS

U.S. Appl. No. 14/910,979, filed Feb. 8, 2016.
U.S. Appl. No. 15/080,316, filed Mar. 24, 2016.
U.S. Appl. No. 15/482,565, filed Apr. 7, 2017.

* cited by examiner

TENT FRAME AND TENT WITH EXTENDED TOP

CROSS-REFERENCE TO RELATED APPLICATIONS

The present application claims priority of Chinese Utility Model Applications CN 201720424348.2 filed Apr. 21, 2017, the entire content of which application is incorporated herein for all purposes by this reference.

FIELD OF THE INVENTION

The present invention generally relates to tent frames and tents, and more particularly, relates to tent frames and tents with extended tops, and connectors facilitating extension of tent tops.

BACKGROUND

Most conventional tents when unfolded have regular polygonal bases such as square or hexagonal bases. Such tents are not selected for uses in many cases that require tents of other shapes such as rectangular bases. To meet the demand for other configurations, a common practice is to interconnect two or more regular tents together, for instance, by sharing middle collars/poles and having cross support poles at top of each shared collar to facilitate folding and unfolding of the tents. Tents with such configurations are complex and not easy to fold and unfold. In addition, they are heavy and require large storage spaces.

Given the current state of the art, there remains a need for tent frames and tents that address the abovementioned issues.

The information disclosed in this Background section is provided for an understanding of the general background of the invention and is not an acknowledgement or suggestion that this information forms part of the prior art already known to a person skilled in the art.

SUMMARY

The present invention is directed to tent frames and tents with extended tops, and connectors facilitating extension of tent tops.

In an aspect, the present invention provides a connector of a tent including a first side wall and a second side wall spaced apart in a first direction to form a groove along a second direction and with an opening facing a third direction. The groove is configured to receive an end of an upper pole of the tent and to allow the upper pole rotate with respect to the connector in a plane limited by the first and second side walls. The connector also includes a first upper lug and a first lower lug extending outwardly from the first wall in the first direction and spaced apart in the third direction to form a first slot. The first slot is configured to receive an end of a first side pole of the tent and to allow the first side pole rotate with respect to the connector in a plane limited by the first upper and lower lugs. The connector further includes a second upper lug and a second lower lug extending outwardly from the second wall in the first direction and spaced apart in the third direction to form a second slot. The second slot is configured to receive an end of a second side pole of the tent to allow the second side pole rotate with respect to the connector in a plane limited by the second upper and lower lugs.

In some exemplary embodiments, the first, second and third directions are substantially perpendicular to each other.

In an exemplary embodiment, each of the first and second side walls is formed with a hole and the upper pole is pivotally coupled with the first and second side walls by a bolt through the holes. In an exemplary embodiment, each of the first upper and lower lugs is formed with a hole and the first side pole is pivotally coupled with the first upper and lower lugs by a bolt through the holes. In an exemplary embodiment, each of the second upper and lower lugs is formed with a hole and the second side pole is pivotally coupled with the second upper and lower lugs by a bolt through the holes.

In some exemplary embodiments, the first upper and lower lugs are substantially the same, and the second upper and lower lugs are substantially the same.

In some exemplary embodiments, the connector further includes a first restriction wall and/or a second restriction wall. The first restriction wall is disposed between the first upper and lower lugs to limit a rotational angle of the first side pole with respect to the upper pole. The second restriction wall is disposed between the second upper and lower lugs to limit a rotational angle of the second side pole with respect to the upper pole.

In some exemplary embodiments, the connector further includes a hole below the groove to receive an end of an auxiliary pole of the tent.

In some exemplary embodiments, the first and second side walls, first upper and lower lugs, and second upper and lower lugs are integrally formed.

In some exemplary embodiments, the connector is substantially symmetric with respect to the groove.

In another aspect, the present invention provides a connector of a tent including a groove, a first slot and a second slot. The groove is configured to receive an end of an upper pole of the tent and to allow the upper pole rotate along a first axis. The first slot is formed at a first side of the groove and is configured to receive an end of a first side pole of the tent and to allow the first side pole rotate along a second axis. The second slot is formed at a second side of the groove and is configured to receive an end of a second side pole of the tent and to allow the second side pole rotate along a third axis. The second and third axes are substantially parallel to each other, and perpendicular to the first axis.

In still another aspect, the present invention provides a tent frame including an upper pole having a first end and a second end, and one or more connectors of the present invention disclosed herein. The one or more connectors includes a first connector. The first end of the upper pole is received in the groove of the first connector and pivotally connected with the first and second side walls of the first connector such that the upper pole is rotatable with respect to the first connector in a plane limited by the first and second side walls of the first connector. The tent frame also includes a first side pole and a second side pole. The first side pole has a first end received in the first slot of the first connector and pivotally connected with the first upper and lower lugs of the first connector such that the first side pole is rotatable with respect to the first connector in a plane limited by the first upper and lower lugs of the first connector. The second side pole has a first end received in the second slot of the first connector and pivotally connected with the second upper and lower lugs of the first connector such that the second side pole is rotatable with respect to the first connector in a plane limited by the second upper and lower lugs of the first connector.

In many exemplary embodiments, the one or more connectors further includes a second connector. The second end of the upper end is received in the groove of the second connector and pivotally connected with the first and second side walls of the second connector such that the upper pole is rotatable with respect to the second connector in a plane limited by the first and second side walls of the second connector. In such embodiments, the tent frame further includes a third side pole and a fourth side pole. The third side pole has a first end received in the first slot of the second connector and pivotally connected with the first upper and lower lugs of the second connector such that the third side pole is rotatable with respect to the second connector in a plane limited by the first upper and lower lugs of the second connector. The fourth side pole has a first end received in the second slot of the second connector and pivotally connected with the second upper and lower lugs of the second connector such that the fourth side pole is rotatable with respect to the second connector in a plane limited by the second upper and lower lugs of the second connector.

In some exemplary embodiments, the tent frame further includes an auxiliary pole, and the first connector further includes a hole below the groove to receive an end of the auxiliary pole.

In an exemplary embodiment, each of the first and second side walls is formed with a hole and the upper pole is pivotally coupled with the first and second side walls by a first bolt through the holes. Each of the first upper and lower lugs is formed with a hole and the first side pole is pivotally coupled with the first upper and lower lugs by a second bolt through the holes. Each of the second upper and lower lugs is formed with a hole and the second side pole is pivotally coupled with the second upper and lower lugs by a third bolt through the holes.

In yet another aspect, the present invention provides a tent frame including an upper pole having a first end and a second end, and one or more connectors of the present invention disclosed herein. The one or more connectors includes a first connector. The first end of the upper pole is received in the groove of the first connector and pivotally connected with the first connector such that the upper pole is rotatable along the first axis of the first connector. The tent frame also includes a first side pole and a second side pole. The first side pole has a first end received in the first slot of the first connector and pivotally connected with the first connector such that the first side pole is rotatable along the second axis of the first connector. The second side pole has a first end received in the second slot of the first connector and pivotally connected with the first connector such that the second side pole is rotatable along the third axis of the first connector.

In some exemplary embodiments, the one or more connectors further include a second connector. The second end of the upper end is received in the groove of the second connector and pivotally connected with the second connector, and the upper pole is rotatable along the first axis of the second connector. The tent frame further includes a third side pole and a fourth side. The third side pole has a first end received in the first slot of the second connector and pivotally connected with the second connector such that the third side pole is rotatable along the second axis of the second connector. The fourth side pole having a first end received in the second slot of the second connector and pivotally connected with the second connector such that the fourth side pole is rotatable along the third axis of the second connector.

In an exemplary embodiment, wherein the first and second connectors are disposed such that the first axis of the second connector is substantially parallel with the first axis of the first connector.

In still yet another aspect, the present invention provides a tent including a tent frame of the present invention, and a tent cloth coupled with and supported by the tent frame.

Exemplary connectors, tent frames and tents of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
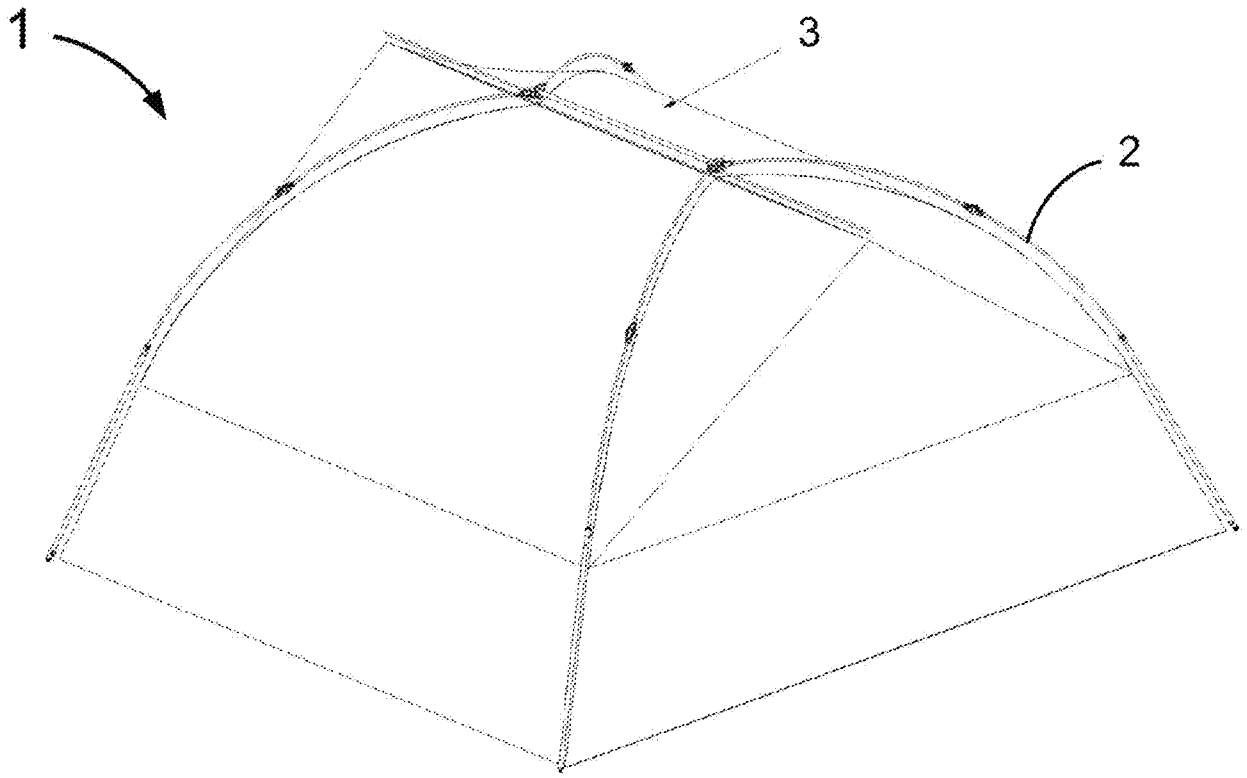
FIG. 1 is a schematic view illustrating an exemplary tent in an unfolded state in accordance with some exemplary embodiments of the present invention.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of tent frames and tents with extended tops when unfolded. As used herein, a tent/tent frame "with extended top" refers to a tent/tent frame with multiple localized peaks or with one extended peak (either flat/smooth or uneven). It should be noted a peak is not necessarily the highest point of the entire tent or tent frame. In some cases, a tent/tent frame with extended top is termed as multiple-top tent/tent frame. For instance, a tent/tent frame with two peaks (or one extended peak) are termed as double-top tent/tent frame.

A tent/tent frame of the present invention generally includes an upper pole, a plurality of side poles, and at least one connector disclosed herein for connecting an end of the upper pole with two or more side poles. The connector is configured in such a way that it facilitates construction of a tent or a tent frame with an extended top while maintaining simple structure and easy folding/unfolding characteristics. In many cases, when unfolded, the upper pole (e.g., the entire length of the upper pole) functions as a top or ceiling of the tent/tent frame. In various cases, the connector also facilitates construction of a tent/tent frame with base/floor of a substantially rectangular shape.

Figure 3:
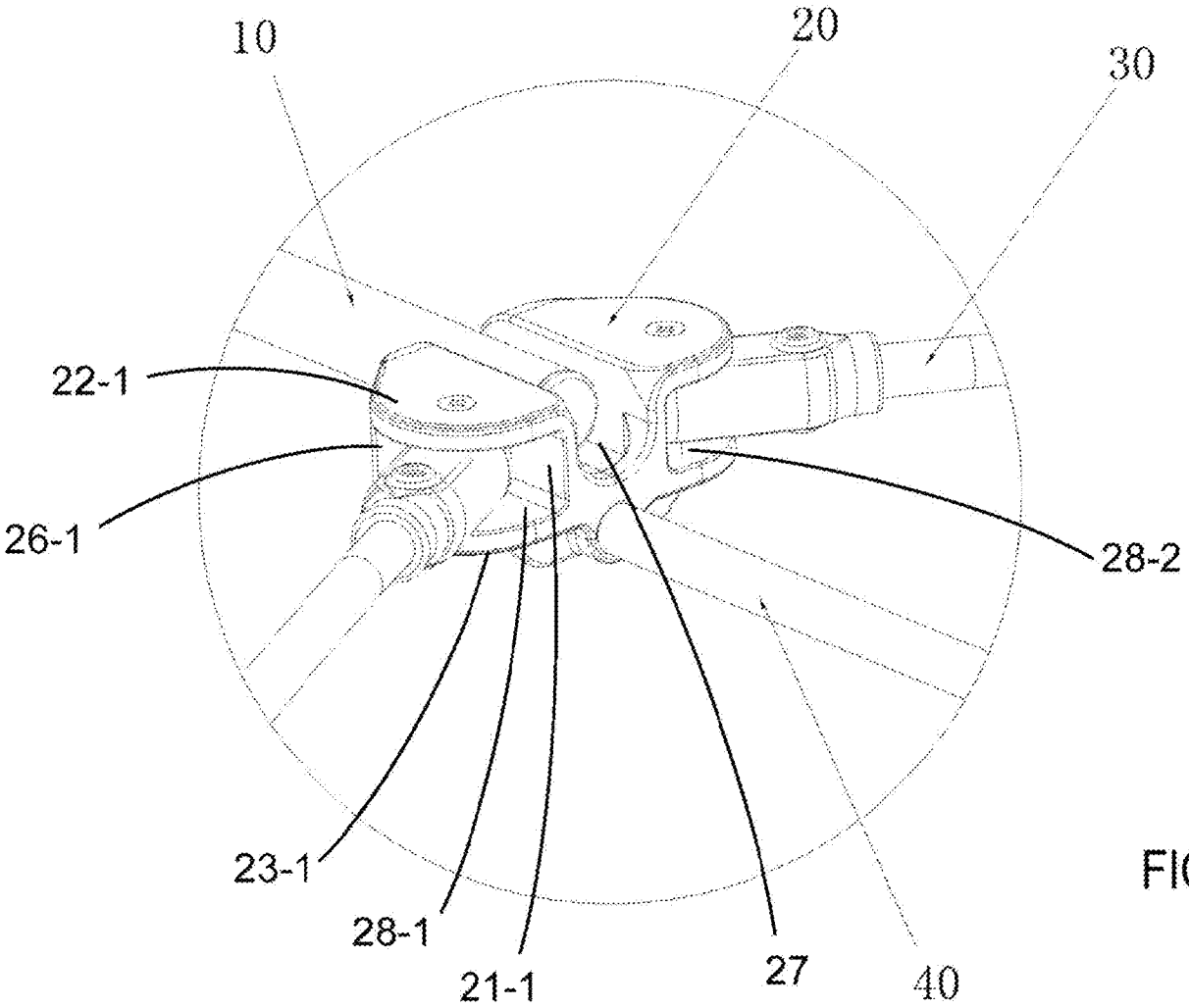
FIG. 3 is a schematic view taken along circle A of FIG. 2.
Figure 4:
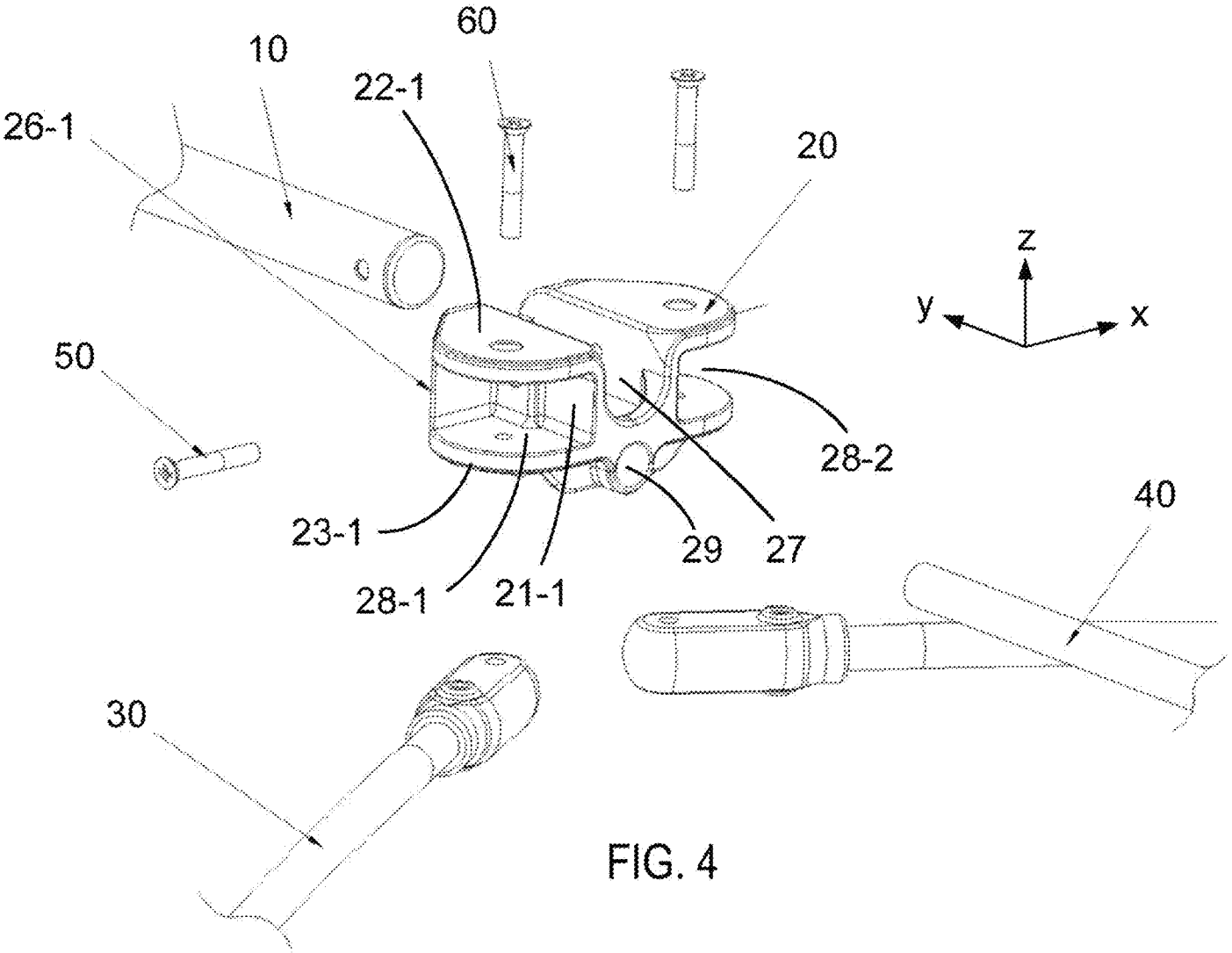
FIG. 4 is a partially disassembled view illustrating the components of FIG. 3.
Figure 5:
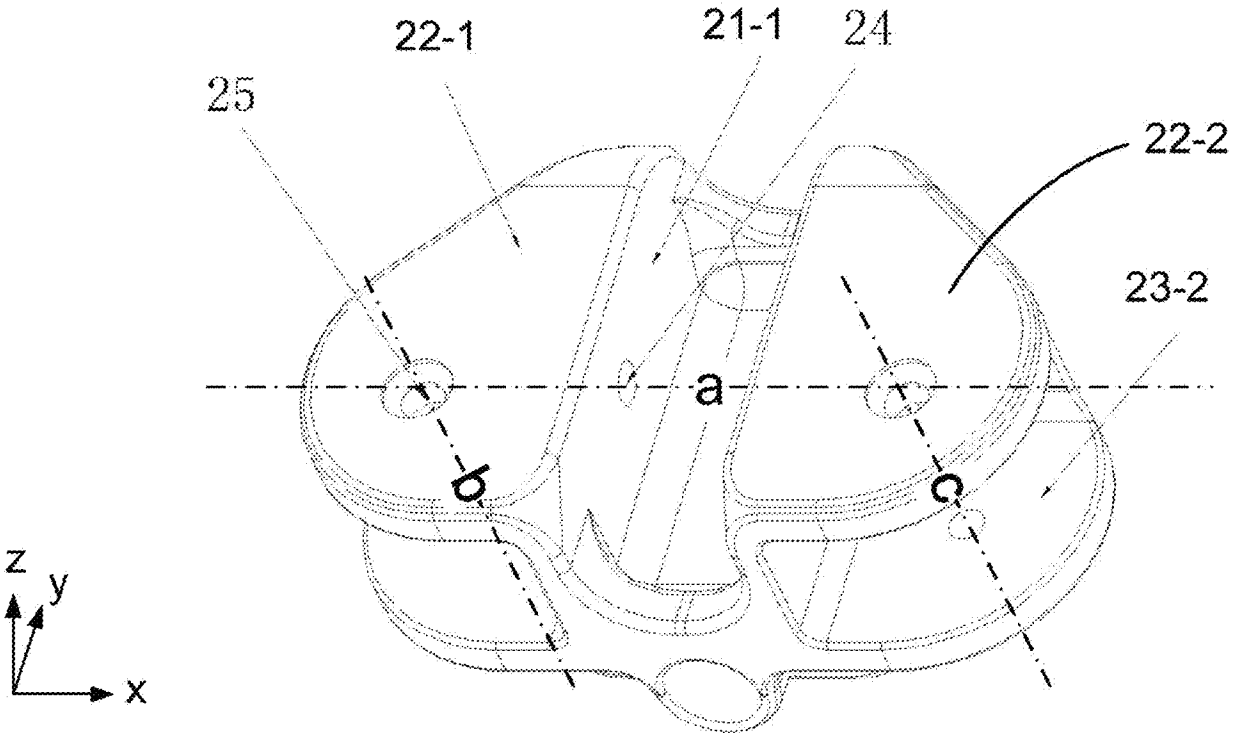
FIG. 5 is a schematic view illustrating a connector in accordance with some exemplary embodiments of the present invention.

Referring now to FIGS. 3-5, there is depicted an exemplary connector in accordance with some exemplary embodiments of the present invention. As shown, exemplary connector 20 includes groove 27, first slot 28-1 at a first side of the groove, and second slot 28-2 at a second side of the groove. The groove, first slot and second slot are configured to receive an end of a pole (e.g., upper pole 10), an end of a first side pole (e.g., side pole 30), and an end of the second side pole (e.g., pole 30), respectively. The end of the upper pole is pivotally connected with connector 20 such that the upper pole is rotatable along a first axis (e.g., axis-a in FIG. 5). The end of the first side pole is pivotally connected with connector 20 such that the first side pole is rotatable along a second axis (e.g., axis-b in FIG. 5). The end of the second side pole is pivotally connected with connector 20 such that the second side pole is rotatable along a third axis (e.g., axis-c in FIG. 5). It should be noted that the first, second and third axes are used herein to designate the rotations (e.g., location and direction) of the upper and side poles with respect to the connector. The connector itself does not necessarily have a revolving (e.g., round, cylindrical, or circular) shape.

In some exemplary embodiments, the second and third axes (e.g., axes b and c) are substantially parallel to each other. In some exemplary embodiments, the second and third axes (e.g., b and c axes) are substantially perpendicular to the first axis (e.g., axis-a).

In many exemplary embodiments, the groove and the slots are formed or confined by spaced-apart solid elements (e.g., walls). For instance, in the illustrated embodiment, connector 20 includes first side wall 21-1 and second side wall 21-2 spaced apart in a first direction (e.g., x direction in FIGS. 4 and 5), and groove 27 is formed between the first and second side walls. The groove is generally along a second direction (e.g., y direction) and with an opening facing a third direction (e.g., z direction). When the end of the upper pole is inserted into the groove and pivotally connected with the connector, the first and second side walls of the connector guide and limit the rotation of the upper pole.

In some exemplary embodiments, connector 20 also includes first upper lug 22-1 and first lower lug 23-1 disposed or formed at the first side wall. The first upper and lower lugs extend outwardly from the first side wall in the first direction (e.g., along –x direction toward the left side in FIG. 5). The first upper and lower lugs are spaced apart in the third direction (e.g., in z direction), and first slot 28-1 is formed between the first upper and lower lugs. When the end of the first side pole is inserted into the first slot and pivotally connected with the connector, the first upper and lower lugs of the connector guide and limit the rotation of the first side pole.

In some exemplary embodiments, connector 20 further includes second upper lug 22-2 and second lower lug 23-2 at the second side wall. The second upper and lower lugs extend outwardly from the second side wall in the first direction (e.g., along x direction toward the right side in FIG. 5). Similar to the first upper and lower lugs, the second upper and lower lugs are spaced apart in the third direction (e.g., in z direction), and second slot 28-2 is formed between the second upper and lower lugs. When the end of the second side pole is inserted into the second slot and pivotally connected with the connector, the second upper and lower lugs of the connector guide and limit the rotation of the second side pole.

The first, second and third directions can be but not necessarily have to be perpendicular to each other. In a case where the x, y and z directions are perpendicular to each other, the rotation of the upper pole is limited in a plane defined by the second and third directions, the rotation of the first side pole in a plane defined by the first and second directions, and the rotation of the second side pole in a plane defined by the first and second directions. In other words, the rotational axes of the first and second side poles are substantially parallel to each other, and are substantially perpendicular to the rotational axis of the upper pole.

The upper and side poles can be pivotally connected with the connector by any suitable means including but not limited to bolts, screws, or snap-fittings. By way of example, FIGS. 3-5 illustrate each of the first and second side walls formed with hole 24 and the upper pole pivotally coupled with the first and second side walls by bolt 50 through the holes. Each of the first upper and lower lugs is formed with hole 25 and the first side pole is pivotally coupled with the first upper and lower lugs by bolt 60 through the holes. Similarly, each of the second upper and lower lugs is formed with hole 25 and the first side pole is pivotally coupled with the first upper and lower lugs by bolt 60 through the holes.

The first (or second) upper and lower lugs can be but not necessarily have to be the same as each other in terms of shape, size or any other configuration. Also, the first upper and lower lugs can be but not necessarily have to be the same as the second upper and lower lugs or symmetric with the second upper and lower lugs. By way of example, FIGS. 3-5 illustrate a symmetric connector with symmetrically disposed first and second upper/lower lugs.

Connector 20 can include additional, alternative or optional components. For instance, in some exemplary embodiments, connector 20 includes first restriction wall 26-1 dispose between the first upper and lower lugs. When a tent is unfolded, first restriction wall 26-1 serves as a stopper to limit a rotational angle of the first side pole with respect to the upper pole, and thus helps to stabilize the tent. Similarly, in some exemplary embodiments, connector 20 includes a second restriction wall disposed between the second upper and lower lugs. When a tent is unfolded, the second restriction wall serves as a stopper to limit a rotational angle of the second side pole with respect to the upper pole, and thus helps to stabilize the tent.

In some exemplary embodiments, connector 20 further includes hole 29 configured to receive an end of an auxiliary pole such as auxiliary pole 40. In an exemplary embodiment, hole 29 is formed below groove 27 and along the second direction (e.g., y direction) of the connector.

Some or all of the components (e.g., the first and second side walls, first upper and lower lugs, and second upper and lower lugs) of the connector can be made integrally. For instance, in an exemplary embodiment, the connector is made by molding a plastic.

As disclosed herein, connector 20 includes a groove and a plurality of side slots in specific directions. Connector 20 can be used to connect an upper pole with a plurality of side poles such that a tent can have an extended top, and in many cases, have a substantially rectangular base (or floor) when folded. A tent or a tent frame of the present invention can include one or more connectors 20 disclosed herein.

Figure 2:
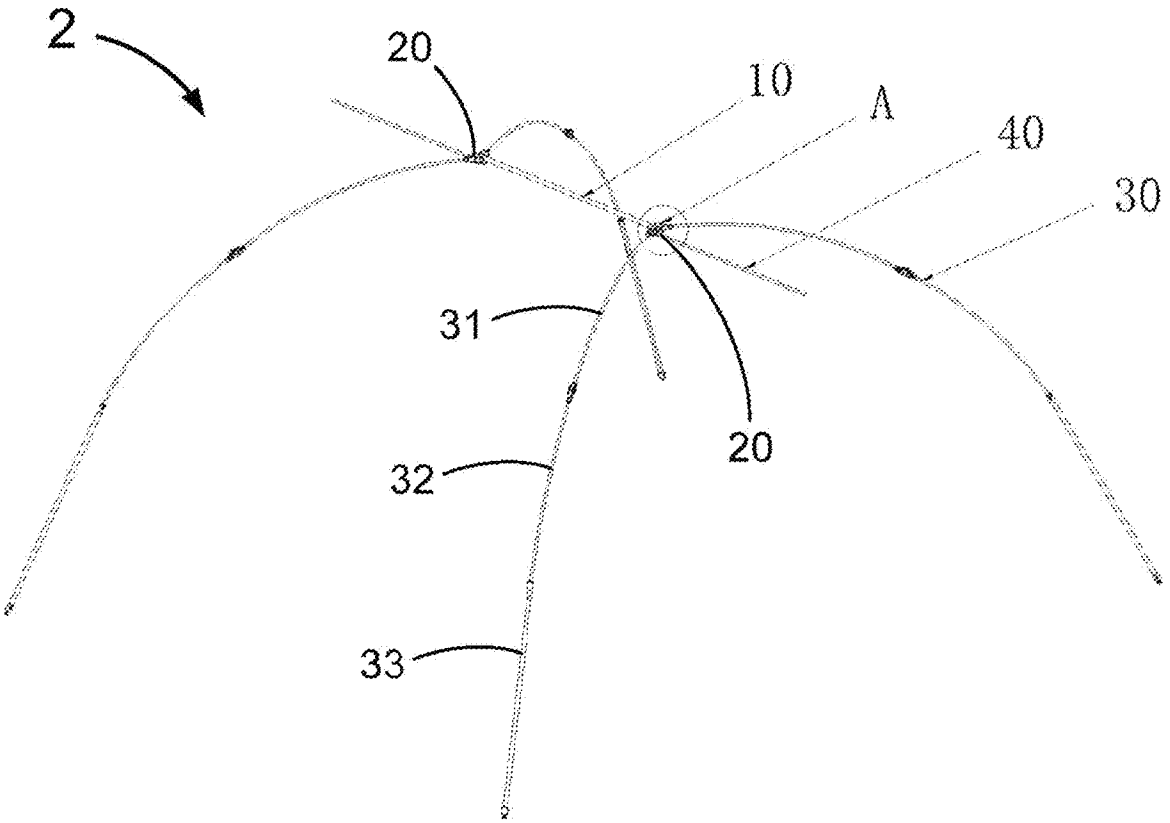
FIG. 2 is a schematic view illustrating an exemplary tent frame in an unfolded state in accordance with some exemplary embodiments of the present invention.

As an example, FIG. 2 illustrates exemplary tent frame 2 including upper pole 10 and a plurality of side poles 30. Upper pole 10 has a first end (e.g., the lower front of the upper pole in the figure) and a second end (e.g., the lower front of the upper pole in the figure). Tent frame 2 also includes a first connector disposed at the first end of the upper pole to couple the first end of the upper pole with a first subset of side poles, and a second connector disposed at the second end of the upper pole to couple the second end of the upper pole with a second subset of side poles. The first and second connectors can be the same as each other or different from each other. At least one of the first and second connectors is connector 20 disclosed herein. In an exemplary embodiment, connector 20 disclosed herein is used as the first connector, where the second connector can be the same as or different from the first connector and can be used to pivotally connect upper pole 10 with other poles including but not limited to side pole 30 depending on the application. In some exemplary embodiments both of the first and second connector are configured as connector 20 disclosed herein.

It should be noted that each side pole can be the same as or different from other side poles. Also, the upper pole or each side pole can be made of one or more poles or pole segments. By way of example, FIG. 2 illustrates each side pole including three poles, of which pole 31 is pivotally connected with pole 32 and pole 32 is telescopically connected with pole 33.

In embodiments where connector 20 disclosed herein is used as the first connector, the groove of the first connector receives the first end of the upper pole, the first slot of the first connector receives an end of a first side pole and the second slot of the first connector receives an end of a second side pole. The first end of the upper pole and the ends of the first and second side poles are pivotally connected with the first connector. In some exemplary embodiments, the first end of the upper pole is rotatable along the first axis of the first connector, the first side pole is rotatable along the second axis of the first connector, and the second side pole is rotatable along the third axis of the first connector.

In some exemplary embodiments, the first end of the upper pole is pivotally connected with the first and second side walls of the first connector such that the upper pole is rotatable with respect to the first connector in a plane limited by the first and second side walls of the first connector. In some embodiments, the end of the first side pole is pivotally connected with the first upper and lower lugs of the first connector such that the first side pole is rotatable with respect to the first connector in a plane limited by the first upper and lower lugs of the first connector. Similarly, in some embodiments, the end of the second side pole is pivotally connected with the second upper and lower lugs of the first connector such that the second side pole is rotatable with respect to the first connector in a plane limited by the second upper and lower lugs of the first connector.

In embodiments where connector 20 disclosed herein is used as the second connector, the groove of the second connector receives the second end of the upper pole, the first slot of the second connector receives an end of a third side pole and the second slot of the second connector receives an end of a fourth side pole. The second end of the upper pole and the ends of the third and fourth side poles are pivotally connected with the second connector. In some exemplary embodiments, the second end of the upper pole is rotatable along the first axis of the second connector, the third side pole is rotatable along the second axis of the second connector, and the fourth side pole is rotatable along the third axis of the second connector.

In some embodiments, the first end of the upper pole is pivotally connected with the first and fourth side walls of the second connector such that the upper pole is rotatable with respect to the second connector in a plane limited by the first and fourth side walls of the second connector. In some embodiments, the end of the third side pole is pivotally connected with the first upper and lower lugs of the second connector such that the third side pole is rotatable with respect to the second connector in a plane limited by the first upper and lower lugs of the second connector. Similarly, in some embodiments, the end of the fourth side pole is pivotally connected with the second upper and lower lugs of the second connector such that the fourth side pole is rotatable with respect to the second connector in a plane limited by the second upper and lower lugs of the second connector.

In an exemplary embodiment, the first and second connectors are disposed such that the first axis of the second connector is substantially parallel with the first axis of the first connector.

The tent frame of the present invention can include additional, optional or alternative components. For instance, in some exemplary embodiments, tent frame 2 further includes one or more auxiliary poles 40, of which a first auxiliary pole is received in hole 29 of the first connector and/or a second auxiliary pole is received in hole 29 of the second connector.

Referring now to FIG. 1, there is depicted exemplary tent 1 including tent frame 2 and tent cloth 3. When unfolded, tent cloth 3 is coupled with and supported by tent frame 2. As illustrated in FIG. 1, auxiliary pole 40 can be used as an eave pole, and when coupled with a tent cloth, it can protect an entrance, a window, a ventilation, or the like of the tent.

Figure 6:
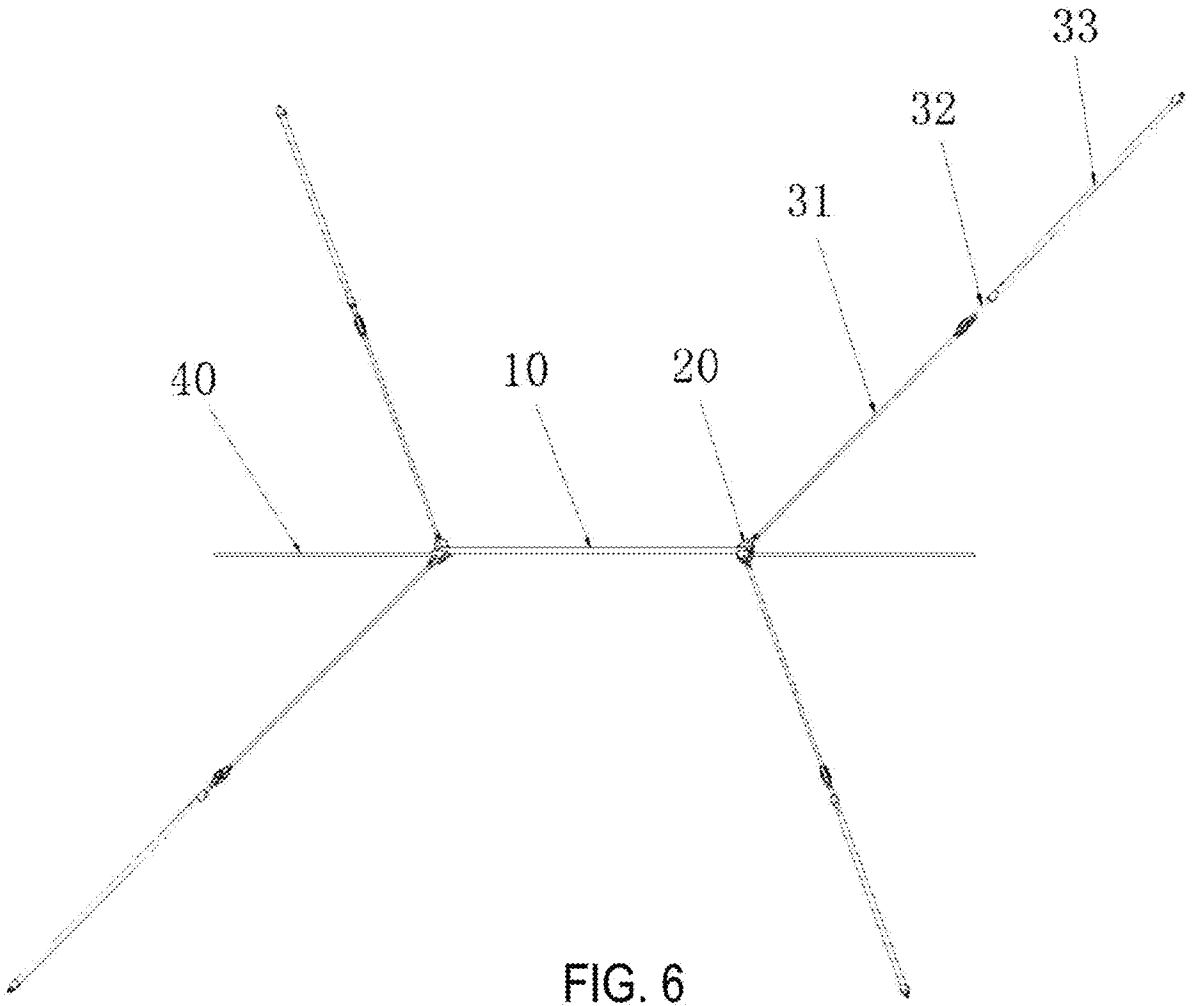
FIG. 6 is a schematic view illustrating the exemplary tent frame of FIG. 2 in a first partially folded state in accordance with some exemplary embodiments of the present invention.
Figure 7:
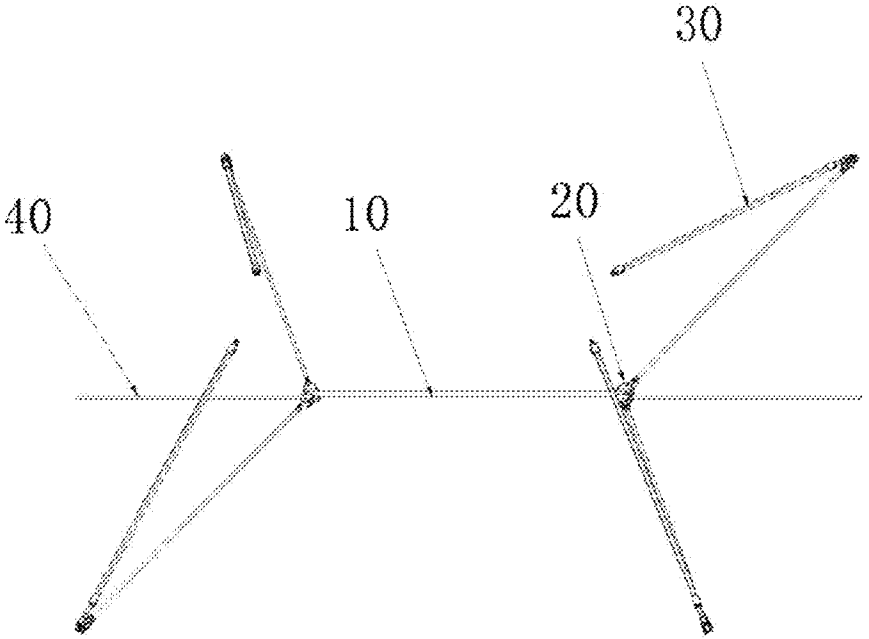
FIG. 7 is a schematic view illustrating the exemplary tent frame of FIG. 2 in a second partially folded state in accordance with some exemplary embodiments of the present invention.
Figure 8:
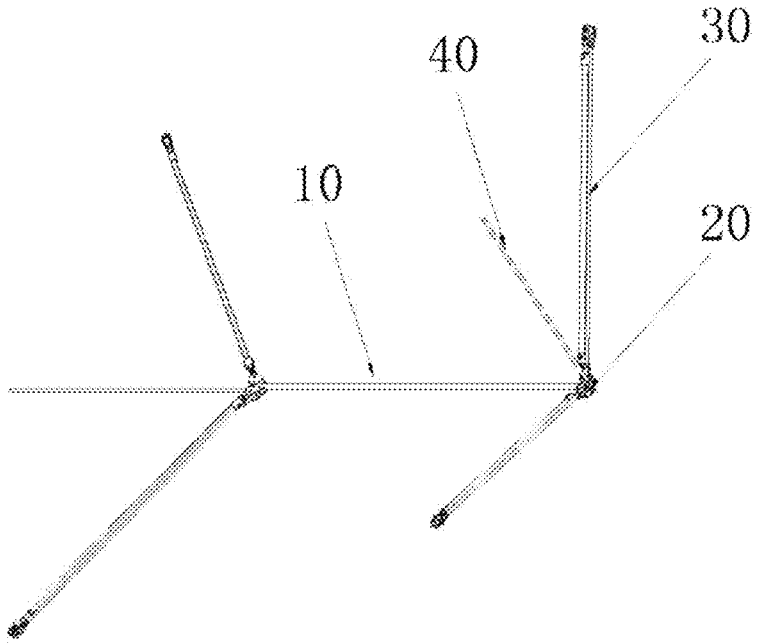
FIG. 8 is a schematic view illustrating the exemplary tent frame of FIG. 2 in a third partially folded state in accordance with some exemplary embodiments of the present invention.
Figure 9:
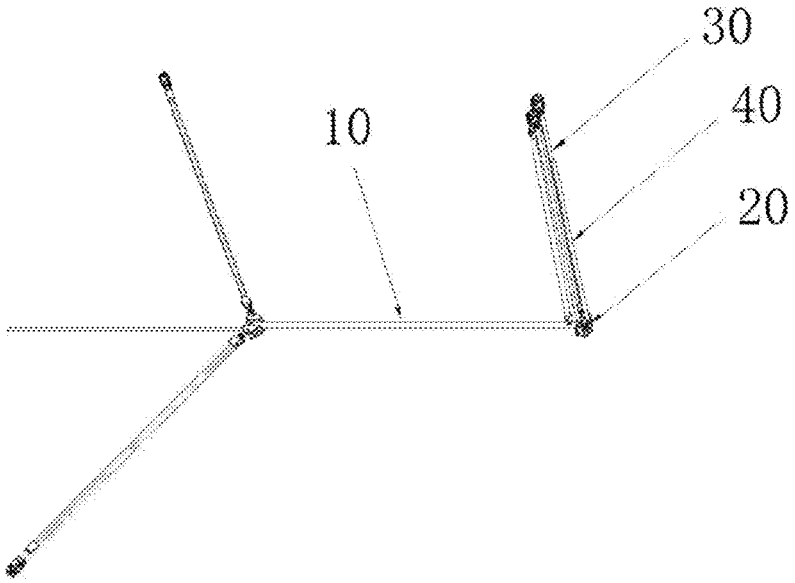
FIG. 9 is a schematic view illustrating the exemplary tent frame of FIG. 2 in a fourth partially folded state in accordance with some exemplary embodiments of the present invention.
Figure 10:
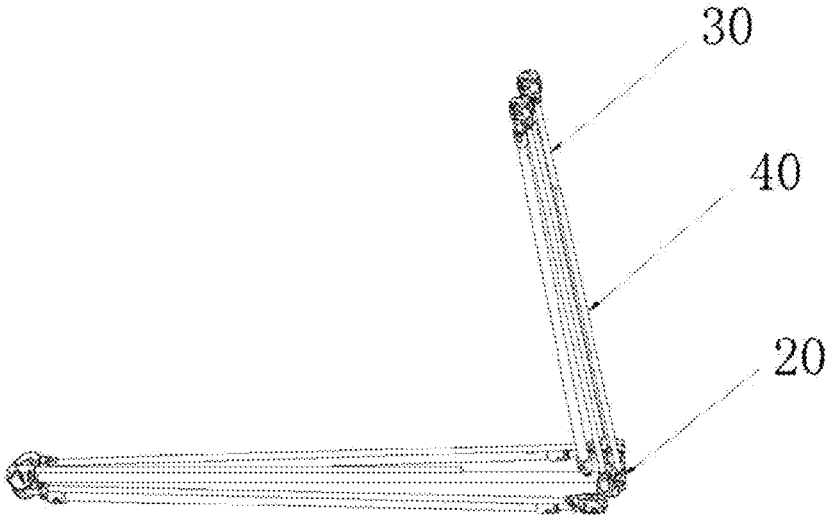
FIG. 10 is a schematic view illustrating the exemplary tent frame of FIG. 2 in a fifth partially folded state in accordance with some exemplary embodiments of the present invention.
Figure 11:
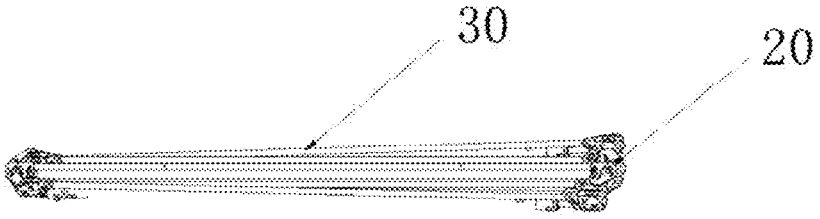
FIG. 11 is a schematic view illustrating the exemplary tent frame of FIG. 2 in a folded state in accordance with some exemplary embodiments of the present invention.

The tent and tent frame of the present invention is easy to fold and unfold. For instance, FIGS. 6-11 illustrate an exemplary folding process. First, fold side pole 30 by retracting pole 33 with pole 32 (or vice versa) as illustrated in FIG. 6, and rotating retracted pole 32 and pole 33 toward pole 31 as illustrated in FIG. 7. Second, fold side pole 30 with auxiliary pole 40 by rotating auxiliary pole 40 upwardly toward upper pole 10 as illustrated in FIG. 8 and rotating side pole 30 toward auxiliary pole 40. Rotation of the auxiliary pole causes connector 20 to rotate with respect to upper pole 10 along axis-a. Alternatively, side pole 30 can be folded toward auxiliary pole 40 prior to rotation of auxiliary pole 40. Third, rotate side pole along with auxiliary pole 40 toward upper pole 10 as illustrated in FIG. 10. A tent of the present invention in a folded state is illustrated in FIG. 11. Reversing the process unfolds the tent.

As disclosed herein, with specifically configured connector(s), a tent/tent frame of the present invention has an extended top, and in many cases, has a base/floor of a substantially rectangular shape. Moreover, comparing to existing tents/tent frames, the tent/tent frame of the present invention has a simple structure and a light weight. Further, the tent/tent frame is easy to fold and unfold. In addition, when unfolded, it requires less storage space.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" or "right", "upper" or "lower", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first slot could be termed a second slot, and, similarly, a second slot could be termed a first slot, without changing the meaning of the description, so long as all occurrences of the "first slot" are renamed consistently and all occurrences of the "second slot" are renamed consistently.

What is claimed is:

1. A connector of a tent comprising:

a first side wall and a second side wall spaced apart in a first direction to form a groove along a second direction and with an opening facing a third direction, wherein the groove is configured to receive an end of an upper pole of the tent and to allow the upper pole rotate with respect to the connector in a plane limited by the first and second side walls;

a first upper lug and a first lower lug extending outwardly from the first wall in the first direction and spaced apart in the third direction to form a first slot, wherein the first slot is configured to receive an end of a first side pole of the tent and to allow the first side pole rotate with respect to the connector in a plane limited by the first upper and lower lugs;

a second upper lug and a second lower lug extending outwardly from the second wall in the first direction and spaced apart in the third direction to form a second slot, wherein the second slot is configured to receive an end of a second side pole of the tent to allow the second side pole rotate with respect to the connector in a plane limited by the second upper and lower lugs; and a hole formed below a bottom of the groove and at a side opposite to the opening of the groove to receive an end of an auxiliary pole of the tent, wherein the hole is formed substantially along the second direction to facilitate positioning of the auxiliary pole of the tent substantially along the second direction.

2. The connector of claim 1, wherein the first, second and third directions are substantially perpendicular to each other.

3. The connector of claim 1, wherein each of the first and second side walls is formed with a hole and the upper pole is pivotally coupled with the first and second side walls by a bolt through the holes.

4. The connector of claim 1, wherein each of the first upper and lower lugs is formed with a hole and the first side pole is pivotally coupled with the first upper and lower lugs by a bolt through the holes.

5. The connector of claim 1, wherein each of the second upper and lower lugs is formed with a hole and the second side pole is pivotally coupled with the second upper and lower lugs by a bolt through the holes.

6. The connector of claim 1, wherein the first upper and lower lugs are substantially the same, and the second upper and lower lugs are substantially the same.

7. The connector of claim 1, wherein the connector is substantially symmetric with respect to the groove.

8. A tent frame comprising:

an upper pole having a first end and a second end;

one or more connectors of claim 1, the one or more connectors comprising a first connector, wherein the first end of the upper pole is received in the groove of the first connector and pivotally connected with the first and second side walls of the first connector, wherein the upper pole is rotatable with respect to the first connector in a plane limited by the first and second side walls of the first connector;

a first side pole having a first end received in the first slot of the first connector and pivotally connected with the first upper and lower lugs of the first connector such that the first side pole is rotatable with respect to the first connector in a plane limited by the first upper and lower lugs of the first connector; and a second side pole having a first end received in the second slot of the first connector and pivotally connected with the second upper and lower lugs of the first connector such that the second side pole is rotatable with respect to the first connector in a plane limited by the second upper and lower lugs of the first connector.

9. The tent frame of claim 8, wherein the one or more connectors further comprises a second connector, the second end of the upper end is received in the groove of the second connector and pivotally connected with the first and second side walls of the second connector, and the upper pole is rotatable with respect to the second connector in a plane limited by the first and second side walls of the second connector, the tent frame further comprising:

a third side pole having a first end received in the first slot of the second connector and pivotally connected with the first upper and lower lugs of the second connector such that the third side pole is rotatable with respect to the second connector in a plane limited by the first upper and lower lugs of the second connector; and a fourth side pole having a first end received in the second slot of the second connector and pivotally connected with the second upper and lower lugs of the second connector such that the fourth side pole is rotatable with respect to the second connector in a plane limited by the second upper and lower lugs of the second connector.

10. The tent frame of claim 8, wherein the first connector further comprises:

a first restriction wall between the first upper and lower lugs of the first connector to prevent the first side pole from rotating beyond its unfolded state; and a second restriction wall between the second upper and lower lugs of the first connector to prevent the second side pole from rotating beyond its unfolded state.

11. The tent frame of claim 8, wherein:

each of the first and second side walls is formed with a hole and the upper pole is pivotally coupled with the first and second side walls by a first bolt through the holes;

each of the first upper and lower lugs is formed with a hole and the first side pole is pivotally coupled with the first upper and lower lugs by a second bolt through the holes; and each of the second upper and lower lugs is formed with a hole and the second side pole is pivotally coupled with the second upper and lower lugs by a third bolt through the holes.

12. A tent comprising: a tent frame of claim 8, and a tent cloth coupled with and supported by the tent frame.

13. A connector of a tent comprising:

a first side wall and a second side wall spaced apart in a first direction to form a groove along a second direction and with an opening facing a third direction, wherein the groove is configured to receive an end of an upper pole of the tent and to allow the upper pole rotate with respect to the connector in a plane limited by the first and second side walls;

a first upper lug and a first lower lug extending outwardly from the first wall in the first direction and spaced apart in the third direction to form a first slot, wherein the first slot is configured to receive an end of a first side pole of the tent and to allow the first side pole rotate with respect to the connector in a plane limited by the first upper and lower lugs;

a second upper lug and a second lower lug extending outwardly from the second wall in the first direction and spaced apart in the third direction to form a second slot, wherein the second slot is configured to receive an end of a second side pole of the tent to allow the second side pole rotate with respect to the connector in a plane limited by the second upper and lower lugs;

a first restriction wall between the first upper and lower lugs to limit a rotational angle of the first side pole with respect to the upper pole; and a second restriction wall between the second upper and lower lugs to limit a rotational angle of the second side pole with respect to the upper pole, wherein the connector is integrally formed with the first restriction wall fixed between the first upper and lower lugs, and the second restriction wall fixed between the second upper and lower lugs.

14. A tent frame comprising an upper pole having a first end and a second end;

one or more connectors comprising a first connector, the first connector comprising:

a first side wall and a second side wall spaced apart in a first direction to form a groove along a second direction and with an opening facing a third direction, wherein the groove is configured to receive an end of an upper pole of the tent and to allow the upper pole rotate with respect to the first connector in a plane limited by the first and second side walls;

a first upper lug and a first lower lug extending outwardly from the first wall in the first direction and spaced apart in the third direction to form a first slot, wherein the first slot is configured to receive an end of a first side pole of the tent and to allow the first side pole rotate with respect to the first connector in a plane limited by the first upper and lower lugs; and a second upper lug and a second lower lug extending outwardly from the second wall in the first direction and spaced apart in the third direction to form a second slot, wherein the second slot is configured to receive an end of a second side pole of the tent to allow the second side pole rotate with respect to the first connector in a plane limited by the second upper and lower lugs;

wherein the first end of the upper pole is received in the groove of the first connector and pivotally connected with the first and second side walls of the first connector, wherein the upper pole is rotatable with respect to the first connector in a plane limited by the first and second side walls of the first connector;

the first side pole having a first end received in the first slot of the first connector and pivotally connected with the first upper and lower lugs of the first connector such that the first side pole is rotatable with respect to the first connector in a plane limited by the first upper and lower lugs of the first connector;

the second side pole having a first end received in the second slot of the first connector and pivotally connected with the second upper and lower lugs of the first connector such that the second side pole is rotatable with respect to the first connector in a plane limited by the second upper and lower lugs of the first connector; and an auxiliary pole, wherein the first connector further comprises a hole below the groove to receive an end of the auxiliary pole.

* * * * *